US006189841B1

(12) United States Patent
LaPoint et al.

(10) Patent No.: US 6,189,841 B1
(45) Date of Patent: Feb. 20, 2001

(54) PAPER INSERT DEVICE

(76) Inventors: Lynette M. LaPoint, 7581 Pebble Springs Ct., Sandy, UT (US) 84093; Lyle J. Martinsen, 315 E. 6310 South, Murray, UT (US) 84107

( * ) Notice: Under 35 U.S.C. 154(b), the term of this patent shall be extended for 0 days.

(21) Appl. No.: 09/519,536

(22) Filed: Mar. 3, 2000

(51) Int. Cl.[7] ..... B65B 67/04

(52) U.S. Cl. ..... 248/99; 248/95; 248/100; 141/114; 141/390; 141/391; 141/10

(58) Field of Search ..... 248/99, 95, 100, 248/6; 383/390; 141/113, 114, 116, 390, 391, 10

(56) References Cited

U.S. PATENT DOCUMENTS

| | | | | |
|---|---|---|---|---|
| 2,693,384 | | 11/1954 | Clarke | 294/1 |
| 3,961,819 | | 6/1976 | Yocum | 294/27 |
| 4,037,778 | * | 7/1977 | Boyle | 229/55 |
| 4,103,952 | | 8/1978 | Thompson | 294/1 |
| 4,268,081 | * | 5/1981 | Hawkinson | 294/55 |
| 4,749,011 | | 6/1988 | Rylander | 141/316 |
| 4,760,982 | | 8/1988 | Cooke | 248/99 |
| 4,884,603 | * | 12/1989 | Simpson | 141/390 |
| 4,890,652 | * | 1/1990 | Hoerner | 141/10 |
| 5,065,965 | | 11/1991 | Aulabaugh | 248/99 |
| 5,080,308 | * | 1/1992 | Franks | 248/99 |
| 5,129,609 | * | 7/1992 | Tobin | 248/97 |
| 5,316,060 | * | 5/1994 | Hodgdon et al. | 141/390 |
| 5,687,781 | * | 11/1997 | Grizz | 141/316 |
| 5,879,039 | * | 3/1999 | Baker et al. | 294/55 |
| 5,918,651 | | 7/1999 | Gazdy | 141/391 |
| 6,007,030 | * | 12/1999 | Judge | 248/95 |

* cited by examiner

*Primary Examiner*—Leslie A. Braun
*Assistant Examiner*—A. Joseph Wujciak
(74) *Attorney, Agent, or Firm*—Thorpe, North & Western

(57) ABSTRACT

An insert apparatus is disclosed which is used to insert items into pouches. The insert apparatus comprises a bending region designed to bend along a length of the apparatus; a non-bending region coupled to the bending region, having a gripping space positioned along a length thereof; a first and second insert foot located on either side of the gripping space; and a transition zone, located between the bending and non-bending regions, where the bend in the bending region gradually flattens out to the non-bending region.

10 Claims, 2 Drawing Sheets

PAPER INSERT DEVICE

BACKGROUND OF THE INVENTION

1. Field of the Invention

This invention relates to devices that aid in the insertion of materials into protective pouches. In particular, there is an insert apparatus which allows easy insertion of items such as papers or similar objects into pouches that performs better than those taught in the prior art.

2. Description of the Related Art

The prior art shows various types of devices that are used to improve the usability of plastic pouches or bags with paper or other objects desired to be inserted into the pouches or bags. Examples of patents related to the present invention are as follows, and each patent is herein incorporated by reference for the supporting teachings:

U.S. Pat. No. 2,693,384, is philatelic tool used to facilitate the insertion of stamps into philatelic albums and the like.

U.S. Pat. No. 3,961,819, is a record tool comprising a generally semicircular arm portion having a handle attached at the mid point of its outer periphery and a semicircular inwardly opening groove along its inner periphery. The arm portion is extended at its opposed ends to form holding members for engaging two opposed side edges of a record cover or jacket. The tool is manipulated to remove a phonograph record from, and reinsert the phonograph record in, a record jacket thus engaged.

U.S. Pat. No. 4,103,952, is a combination bag and scoop used for cleaning up waste material when walking one's pet. The bag includes a closed bottom portion for holding waste material and an upper portion having an open mouth for insertion of waste material into the bag and closing means for closing the bottom portion of the bag after placing waste material within. The bottom portion is constructed of a flexible, impermeable material such as high density polyethylene. The upper portion which is also preferably constructed of a high density polyethylene includes two relatively flat parallel sidewalls adjacent to one another. Each of the sidewalls is provided with a finger insert at one end thereof with both of the inserts located at the same wend of the upper portion. The upper portion is rigid to the extend that upon insertion of a finger and a thumb or a pair of fingers in the inserts, the mouth can be spread open by bowing the sidewalls. However, the upper portion is also resilient to the extent that upon withdrawal of a finger and a thumb from the inserts, the sidewalls resume their flat parallel relationship. The scoop includes a handle and a scooping portion for scooping waste material into the bag when the mouth is spread open. The scoop is placed in the bag after use and the bottom portion is then closed by the closing means to substantially eliminate spillage and odors.

U.S. Pat. No. 4,749,011, discloses a device for use with a flexible bag used to hold the bag open for facilitating access to the interior thereof, and comprising a body having a normal substantially flat planar configuration and sufficiently flexible for responding to pressure thereagainst for deforming into a substantially cylindrical configuration, one cylindrical configuration thereof being of a diametric size smaller than the diametric size of the bag for facilitating insertion of the body into the interior of the bag, and the body having sufficient memory characteristics for springing radially outwardly from the one cylindrical configuration for restriction by the sidewall of the bag whereby the bag is retained in a fully open position, the body being responsive to the release of pressure thereagainst for returning to the normal flat planar configuration thereof.

U.S. Pat. No. 4,760,982, is an apparatus for holding a bag open to assist in the filling thereof. The apparatus may include a relatively rigid middle panel at the opposite edges of which are attached relatively rigid side panels. The side panels are attached by hinges which allow them to move, relative to the middle panel, from coplanar flat positions to positions substantially perpendicular thereto, allowing insertion of the apparatus into a bag. The side panels are preferably biased away from the perpendicular positions toward the coplanar flat position so that when inserted into the bag, the bag is automatically held open by the apparatus.

U.S. Pat. No. 5,065,965, is a trash bag holder comprising a collapsible frame to which is inserted preferably in its collapsed condition into a trash bag and then opened to provide supports for the sides of the bag while trash is swept into the bag while it is laid horizontally on the ground. This holder has a flap at the front of the frame which facilitates the sweeping of trash into the bag. Where desired, an additional support may be provided to hold the top side of the bat when it is laid on the ground. When the bag is filled, the frame is easily withdrawn.

U.S. Pat. No. 5,918,651, is a bag holding device which maintains a conventional storage bag, typically used for freezing, in an upright and opened position for facilitating packaging. The holder comprises a base stand and a removable funnel. Both the stand and funnel are oval in shape, similar to the conventional bag.

The foregoing patents reflect the state of the art of which the applicant is aware and are tendered with a view toward discharging applicant's acknowledged duty of candor in disclosing information that may be pertinent in the examination of the application. It is respectfully stipulated, however, that none of these patents teach or render obvious, singly or when considered in combination, applicant's claimed invention.

3. Problems with the Prior Art

In recent years, activities such as scrapbooking, art, assembling school reports, preparing formal presentations or business reports, collecting baseball cards, photography, and other related pursuits have increasingly involved the use of envelopes, pouches, and sheet-protectors to protect important documents or other items from being folded, touched, bent, or otherwise intentionally or unintentionally defaced or injured. These envelopes and sheet protectors are produced from various materials in many shapes and sizes, some punched to fit into three-ring binders; some sized specifically to fit photographs, cards or stamps particular sizes; some for use in shipping; and others made to accommodate fill-sized sheets of paper.

Common to the use of many of these sheet protectors, however, are several difficulties. First, due to their plastic construction, they are difficult to open since the individual sides of the sheet protector adhere together. Second, once the sides have been initially separated, static electricity tends to pull and hold the two sides of the sheet protector tightly together, making it difficult to insert desired items. Attempts to force documents, etc., into such protectors can cause some of the very damage the sheet protector is intended to prevent. Further, many of the applications noted above call for the insertion of two documents into a sheet protector—one facing each direction. This is often difficult since the static electricity which held the sides of the sheet protector together also holds papers previously inserted into the protector. This makes insertion of a second document similarly difficult, and again brings up the risks of wrinkling, bending, or folding noted above.

There is thus a need for an insert apparatus which is easily inserted into a sheet protector or similar pouch or envelope, holds the sides of the sheet protector apart, allows for easy insertion of an item, allows for the insertion of a second item, and which is then easily removed without withdrawing the items thus inserted.

SUMMARY OF THE INVENTION

It is a feature of the invention to provide an insert apparatus, used to insert an item into a pouch. In particular, there is an insert apparatus that performs better than those disclosed in the prior art.

A further feature of the invention is to provide an insert apparatus, comprising a bending region, designed to form a bend along a length thereof; a non-bending region, coupled to the bending region, having a gripping space positioned along a length thereof, and a first and second insert foot, located on either side of the gripping space; and a transition zone located between the bending and non-bending regions, where the bend in the bending region gradually flattens out to the non-bending region.

An additional feature of the invention is to provide an insert apparatus wherein the gripping space is wide enough to allow items inside the pouch to be gripped by a user through sides of the pouch without gripping the first and second insert feet.

A further feature of the invention is to provide an insert apparatus wherein the gripping space is V-shaped.

An additional feature of the invention is to provide an insert apparatus wherein the gripping space is shallow in depth.

A further feature of the invention is to provide an insert apparatus wherein the gripping space has a short width relative to the width of the apparatus.

An added feature of the invention is to provide an insert apparatus wherein a width of the apparatus decreases in size along a length thereof.

A further feature of the invention is to provide an insert apparatus wherein the bending region comprises a holding region used to manipulate the insert apparatus, which also comprises a set of finger holes located on either side of a center line between which force is applied to bend the insert apparatus.

An additional feature of the invention is to provide an insert apparatus wherein the finger holes further have soft finger guards.

A further specific feature of the invention is to provide an insert apparatus, wherein the pouch with which the apparatus is used is a sheet protector used for scrapbooks.

The invention resides not in any one of these features per se, but rather in the particular combination of all of them herein disclosed and claimed, and it is distinguished from the prior art in this particular combination of all of its structures for the functions specified.

There has thus been outlined, rather broadly, the more important features of the invention so that the detailed description thereof that follows may be better understood, and so that the present contribution to the art may be better appreciated. There are, of course, additional features of the invention that will be described hereinafter which would form the subject matter of the claims appended hereto. Those who are skilled in the art will appreciate that the conception, upon which this disclosure is based, may readily be utilized as a basis for the designing of other structures, methods, and systems for carrying out the several purposes of the present invention. It is important, therefore, that the claims are regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, neither is it intended to be limiting as to the scope of the invention in any way.

Other features of the present invention will become clearer from the following detailed description of the invention, taken with the accompanying drawings and claims, or may be learned by the practice of the invention.

It is noted that the drawings of the invention are not to scale. The drawings are merely schematic representations not intended to portray specific parameters of the invention. The drawings are intended to depict only typical embodiments of the invention, and therefore should not be considered as limiting the scope of the invention. The invention will be described with additional specificity and detail through the use of the accompanying drawings. Like numbering used on different drawings represents like elements.

CHARTER BY THE U.S. CONSTITUTION

This disclosure of the invention is submitted in furtherance of the constitutional purposes of the United States Patent Laws "to promote the progress of science and useful arts," as stated in Article 1, Section 8 of the United States Constitution.

DETAILED DESCRIPTION OF THE PREFERRED EMBODIMENT

Figure 1:
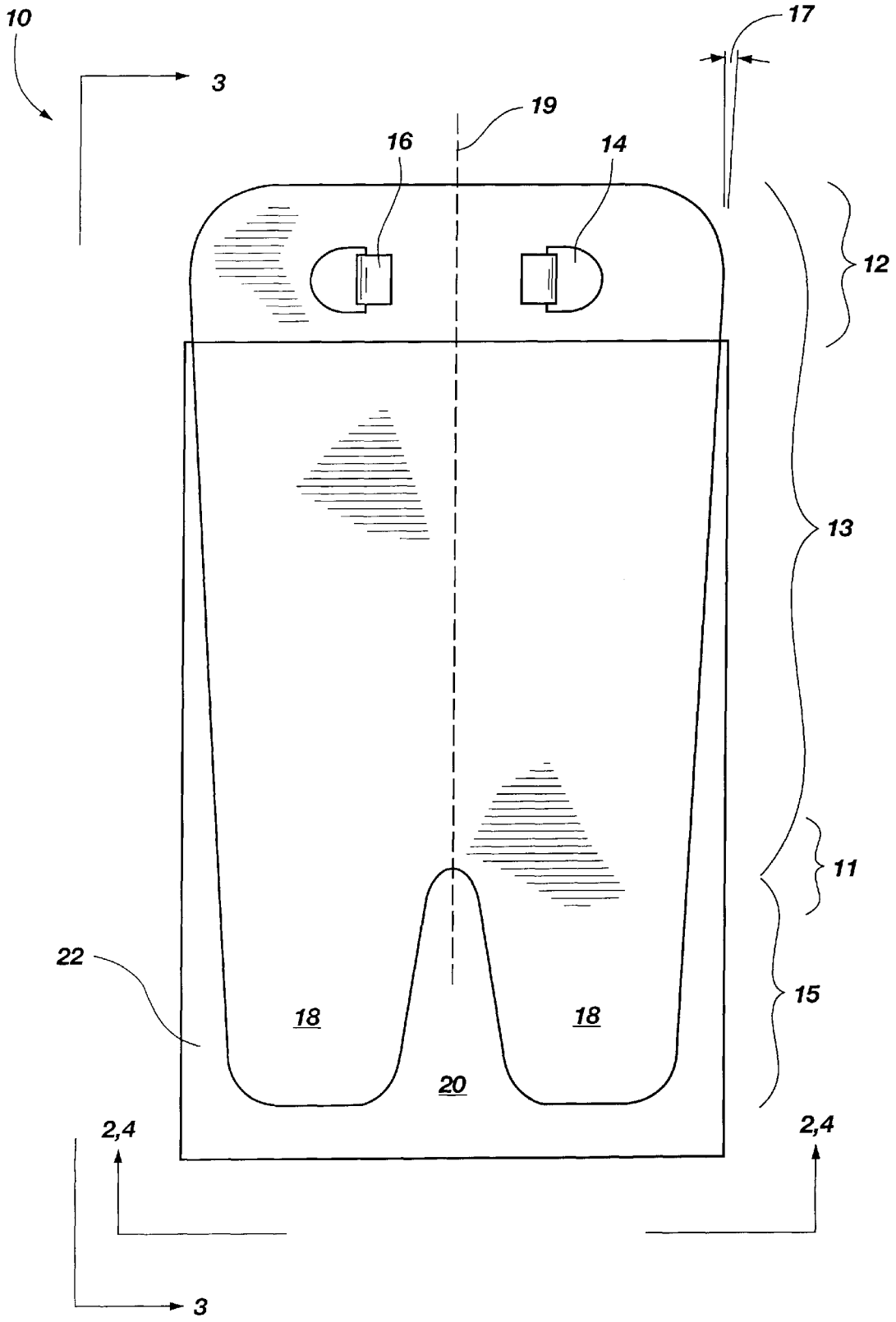
FIG. 1 is a top view of an insert apparatus in its inserted position.

Referring to FIG. 1 there is a top view of an insert apparatus in its inserted position. Specifically, there is an insert apparatus 10, having holding region 12, bending region 13, finger holes 14, nonbending (or "flattened") region 15, soft finger guards 16, diminishing angle 17, transition zone 11, insert feet 18, center line 19, and gripping space 20. Shown with the apparatus in FIG. 1–FIG. 4 is envelope (or "pouch") 22, used for protecting items such as but not limited to photographs, documents, baseball cards, etc.

Figure 2:
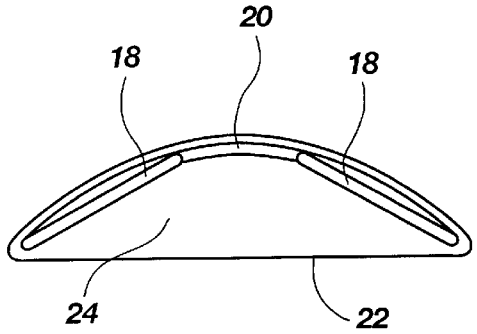
FIG. 2 is an end view of the embodiment of FIG. 1.

FIG. 2 is an end view of FIG. 1 taken along line 2 of FIG. 1. Specifically, a bending of insert apparatus 10 and its subsequent insertion into envelope 22 creates insert cavity 24. Cavity 24 allows for the easy insertion of items into envelope 22.

Figure 3:
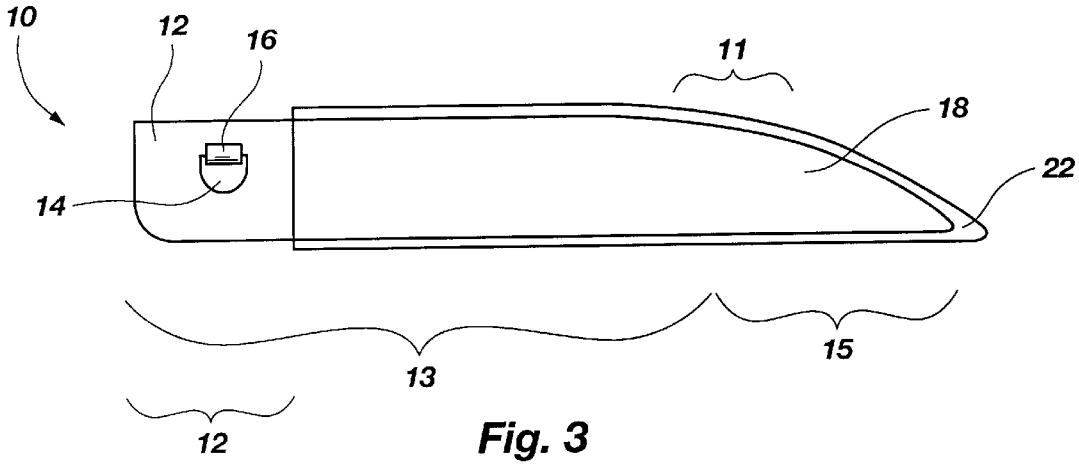
FIG. 3 is a side view of the embodiment of FIG. 1.

FIG. 3 is a side view of FIG. 1, showing insert apparatus 10 in its inserted position. Uniquely, in operation, insert feet 18, located in non-bending region 15, are placed into the envelope first. Apparatus 10 is then bent by applying pressure either inwardly to finger holes 14, or to a space between finger holes 14, thus causing the apparatus to bend along a line such as center line 19. The resilient nature of apparatus 10 causes its edges to fit snugly against the edges of envelope 22, as apparatus 10 is slid into envelope 22, thus holding envelope 22 open and creating insert cavity 24. Items may then be inserted into insert cavity 24. To remove apparatus 10, the user grips envelope 22 and the item inserted on gripping space 20, and then withdraws apparatus 10 from envelope 22, leaving the inserted item within envelope 22.

Figure 4:
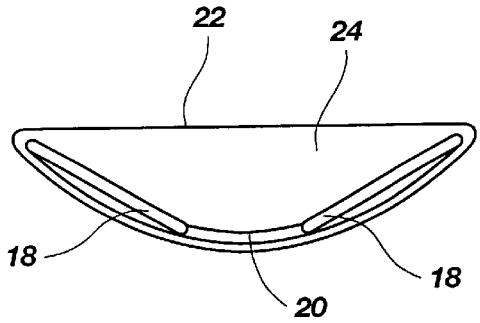
FIG. 4 is an inverted end view of the embodiment of FIG. 1.

FIG. 4 is an end view of FIG. 1 taken along line 4 of FIG. 1. Uniquely, FIG. 4 differs from FIG. 2 in that in FIG. 4, insert apparatus 10 has been deflected along center line 19 in a direction opposite from that shown in FIG. 2, thus opening insert cavity 24 on the opposite side of the apparatus. This allows for the insertion of a second document, photograph, or other item into envelope 22 without requiring the removal and reinsertion of apparatus 10.

Remarks About the Preferred Embodiment

One of ordinary skill in the art of designing document handling equipment will realize many advantages from using the preferred embodiment. First, a skilled artisan would appreciate that gripping space 20 predisposes the location for bending of the insert apparatus 110. This predisposed bending location reduces the amount of resistance that must be overcome when bending insert apparatus 110. Additionally, gripping space 20 allows the user to hold the inserted items in place while apparatus 10 is removed. In regard to this final point, without the gripping space, static electricity would cause items to adhere to insert apparatus 10, thus causing them to exit envelope 22 when apparatus 10 is withdrawn. Uniquely, gripping space 20 allows a user to pinch together the sides of envelope 22, thus holding any inserted items in place while apparatus 10 is removed.

Further, a skilled artisan would recognize that the existence of gripping space 20 allows insert feet 18 to remain in a flat position, but angled to each other, and not curved, like the rest of the apparatus. This characteristic allows insert feet 18 to better conform to the flat end of envelope 22.

A skilled artisan would similarly appreciate that the gripping space 20 creates two distinct regions on the apparatus-bending region 13 and non-bending region 15. Such an artisan would see that the increased area given by the curved shape of bending region 13 allows for easy insertion of items, while the angled non-bending region 15 helps to guide items into place within the envelope without allowing damage.

Similarly, one skilled in the art would recognize the benefits of the transition zone 11 found roughly in the area outlined in the figures. This zone is where bending region 13 gradually flattens out to nonbending region 15.

A skilled artisan would further recognize the benefits of the apparatus's gradual decrease in width along the bending section 13 to the ends of insert feet 18. The narrower width at the edge of the apparatus 10 by the insert feet 18 allows for easy insertion into sheet protectors or other pouches, while causing a gradual decrease in the curving of apparatus 10 along its length. In bending region 13, apparatus 10 is at its widest, thus causing a wide insert cavity 24 to be formed upon insertion into envelope 22.

One skilled in this art would similarly recognize the benefits of the curved nature of the apparatus in its bent form. By laying documents or photographs against the curved face of apparatus 10 and allowing the documents to conform to the curved face, their edges are located away from envelope 22. Thus, document edges are easily inserted without becoming caught on the sides of envelope 22.

One skilled in the art would further recognize that when the insert apparatus is not actuated, (or "bent"), all elements of the illustrated invention are coplanar.

Finally, one skilled in this art would highly value the property of the preferred embodiment to be inverted. Specifically, after loading one document into envelope 22, apparatus 10 may be inverted by applying pressure to the convex surface of the device, thus closing insert cavity 24 and securing the document against the formerly open side of envelope 22, while opening a new insert cavity 24 on the opposite side of apparatus 10, thus allowing for the insertion of a second object into envelope 22.

VARIATIONS OF THE INVENTION

A skilled artisan would consider it an obvious design change to use different sizes and dimensions of plastic sheets in constructing the apparatus in order to accommodate different types or sizes of page protectors, envelopes, or pouches. Further, although herein referred to as "envelopes" or "pouches," one skilled in the art would understand that the invention may be used with any pouch used to protect documents or other items, such as but not limited to sheet protectors, envelopes, pouches, stamp protectors, baseball card protectors, photo album protectors, and scrapbook page protectors.

In addition, the apparatus 10 could be varied in thickness in order to provide easier bending, or greater strength and resilience. The spacing of finger holes 14 could be varied, according to size or purpose of the apparatus, and the finger guards could be either removed or augmented. Indeed, the finger holes themselves could be omitted—especially with smaller sizes of the apparatus—or augmented. The narrowing of the apparatus from bending region to non-bending region could be accentuated, lessened, or reversed to better suit individual purposes. Further, gripping space 20 could be made deeper or more shallow, or the width of gripping space 20 could be expanded or narrowed. The gripping space could be made in any shape, such as v-shaped, u-shaped, circular, heart-shaped, square, oval, etc. Changes in the gripping space depth could also be made to allow for a narrower paper cavity 24, and a longer non-bending region 15. Further, secondary gripping spaces could be added to give alternative places for holding items in place after inserted. Angle 17 can be a constant along the length or can change to a greater or lesser angle along the length of apparatus 10.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is thus indicated by the appended claims rather than by the foregoing description. All changes that come within the meaning and range of equivalency of the claims are to be embraced within their scope.

What is claimed and desired to be secured by United States Patent is:

1. An insert apparatus (10), used to insert an item into a pouch (22), comprising:

a) a bending region (13), designed to form a bend along a length thereof;

b) a non-bending region (15), coupled to the bending region, having:

1) a gripping space (20), positioned along a length thereof;

2) first and second insert foot (18), located on either side of the gripping space; and c) a transition zone (11), located between the bending and non-bending regions, where the bend in the bending region gradually flattens out to the non-bending region.

2. The apparatus of claim 1, wherein the gripping space (20) is wide enough to allow items inside the pouch to be gripped by a user through sides of the pouch without gripping the first and second insert feet.

3. The apparatus of claim 2, wherein the gripping space (20) is V-shaped.

4. The apparatus of claim 3, wherein the pouch is a sheet protector used for scrapbooks.

5. The apparatus of claim 2, wherein the gripping space (20) is shallow in depth.

6. The apparatus of claim 2, wherein the gripping space (20) has a short width relative to the width of the apparatus.

7. The apparatus of claim 2, wherein a width of the apparatus (10) decreases in size along a length thereof.

8. The apparatus of claim 2, wherein the bending region (13) comprises a holding region (12), used to manipulate the insert apparatus.

9. The apparatus of claim 8 wherein the holding region comprises a set of finger holes (14), located on either side of a center line (19), between which force is applied to bend the insert apparatus.

10. The apparatus of claim 9 wherein the finger holes further have soft finger guards (16).

* * * * *